United States Patent [19]

Legille

[11] 4,027,605

[45] June 7, 1977

[54] IMPROVED TUYERE FEED DEVICE

[75] Inventor: Edouard Legille, Luxembourg, Luxembourg

[73] Assignee: S.A. des Anciens Etablissements Paul Wurth, Luxembourg, Luxembourg

[22] Filed: Mar. 6, 1973

[21] Appl. No.: 339,117

[30] Foreign Application Priority Data

Mar. 6, 1972 Luxembourg ..... 064911

[52] U.S. Cl. ..... 110/182.5; 266/270

[51] Int. Cl.[2] ..... F23L 1/00; C21B 7/16

[58] Field of Search ..... 110/182.5; 122/6.5, 122/6.6; 241/189, 265, 270

[56] References Cited

UNITED STATES PATENTS

| | | | |
|---|---|---|---|
| 726,422 | 4/1903 | Garretson | 110/182.5 |
| 3,520,525 | 7/1970 | Zimmermann | 122/6.6 |
| 3,558,119 | 1/1971 | Demalander | 110/182.5 |
| 3,662,696 | 5/1972 | Mahr et al. | 110/182.5 |
| 3,766,868 | 10/1973 | Mahr | 110/182.5 |

FOREIGN PATENTS OR APPLICATIONS

| | | | |
|---|---|---|---|
| 142,658 | 12/1960 | U.S.S.R. | 122/6.6 |

*Primary Examiner*—Kenneth W. Sprague

[57] ABSTRACT

A tuyere stock for use in the delivery of heated gas from a source to a furnace and characterized by the provision of a rigid connection between the injection nozzle portion of the stock and the blast tuyere which injects the heated gas to the furnace interior is disclosed. The injection nozzle portion of the tuyere stock is supported by guide means which maintains the blast tuyere in its proper operating position by preventing angular movement thereof while permitting motion thereof resulting from thermal expansion. The tuyere stock is further characterized by means which urges the blast tuyere against the furnace wall with a preselected minimum force.

15 Claims, 2 Drawing Figures

IMPROVED TUYERE FEED DEVICE

BACKGROUND OF THE INVENTION

1. Field of the Invention

The present invention relates to the transmission of heated fluids. More specifically, the present invention is directed to improved tuyere feed lines for use in the delivery of heated gas to the interior of a furnace. Accordingly, the general objects of the present invention are to provide novel and improved methods and apparatus of such character.

2. Description of the Prior Art

While not limited thereto in its utility, the present invention is particularly well suited for use as an improved tuyere feed line for shaft furnaces. In shaft furnaces, particularly in blast furnaces, preheated air is injected into the furnace through nozzles or tuyeres. The preheated air is delivered to the vicinity of the injection nozzles via a common "hot-blast" main supply, known in the art as a bustle pipe, which is mounted exterior of and around the furnace. A plurality of nozzles, known in the art as blast tuyeres, are located about the periphery of the furnace for discharge into the furnace and these blast tuyeres are connected to the bustle pipe by means of feed lines or conduits known in the art as tuyere stocks.

Prior art tuyere stocks typically comprise a number of tubular members which are lined internally with a refractory material. The individual tuyere stocks are coupled, via flange type connections, to connection sockets provided on the hot gas supply device surrounding the furnace. In order to compensate for misalignments, which may arise due to manufacturing and installation inaccuracies, and thermal expansion which occurs during operation, some or al of the tubular members which comprise the individual tuyere stocks are interconnected by means of expansion balls, pivot compensators or similar devices. U.S. Pat. No. 3,662,696 and U.S. application Ser. No. 228,417, now U.S. Pat. No. 3,766,868, both assigned to the same assignee as the present invention, disclose tuyere stock apparatus in which the joints between the individual tubular members are formed by means of universal couplings and cooperating flexible hermetic coupling means. Use of the tuyere stocks of the referenced patent and application will result in the compensation for deformations caused by thermal expansion due to the heated gas in a manner which does not require the use of prior art ball and socket type connecting joints.

In the prior art, including the apparatus of referenced U.S Pat. No. 3,662,696 and copending application Ser. No. 228,417, now U.S. Pat. No. 3,766,868, the injection nozzle portion of the tuyere stock is urged against the blast tuyere in the furnace wall by means of clamping devices in the interest of establishing a leak-proof fluid coupling between these elements. The point of contact between the injection nozzle and the blast tuyere has previously been in the form of a spherical sealing surface defined by the end of the injection nozzle; the use of a spherical joint being in the interest of compensating for any relative angular displacements between these elements. Although the prior art apparatus satisfactorily compensates for most deformations experienced in practice, particularly for thermal expansion and contraction, the injection nozzle of the tuyere stock is often displaced from its central position relative to the blast tuyere cooperating seating surface during operation. Although the spherical sealing surface configuration permits small deviations from the central position, there is an inherent risk that a gap will form at the seating surface between the injection nozzle and blast tuyere. Should such a gap form, the heat transfer relationship between the injection nozzle and the water cooled blast tuyere will be unbalanced and at least a portion of the spherical sealing surface will be subject to a temperature build-up as well as to the impact of the hot air being delivered to the furnace. The temperature rise in combination with the hot air impact will rapidly attack and destroy the spherical seating surface of the tuyere stock. Obviously, the higher the pressure and temperature the faster the erosion of the spherical seating surface will occur. Although the blast tuyere is water cooled, this element is also likely to be damaged and possibly destroyed as a result of the impact of the preheated air against a sealing surface which is at an angle to the direction of gas flow and which is exposed when a gap forms between the blast tuyere and tuyere stock injection nozzle.

Should either the tuyere stock injection nozzle or blast tuyere suffer damage thus requiring the replacement thereof, it is necessary to completely shut-down the furnace. The repair operation is, of course, thus time consuming and expensive. Additionally, the reinsertion of the tuyere stock in a new blast tuyere, or the installation of a new tuyere stock injection nozzle, requires accurate positioning of the elements to insure that a satisfactory seal will be achieved between the injection nozzle and blast tuyere in order to prevent immediate damage to the spherical sealing surface upon resumption of blast furnace operation.

SUMMARY OF THE INVENTION

The present invention overcomes the above discussed and other disadvantages and deficiencies of the prior art by providing a novel and improved tuyere stock assembly which prevents the injection nozzle from becoming displaced out of its desired central position relative to the blast tuyere. The foregoing and other advantages of the invention are achieved by a novel support mechanism and a connection between the injection nozzle and blast tuyere which permits both elements to be removed and replaced at the same time should this become necessary.

In accordance with the present invention at least a first alignment surface is provided on the bottom side of the injection nozzle portion of the tuyere stock. Additionally, the wall of the blast furnace is provided with a guide device which cooperates in a sliding relationship, with the alignment surface on the injection nozzle to insure that the nozzle is maintained in its proper operating position. The guide device mounted on the blast furnace wall is also designed to insure that any relative angular motion between the injection nozzle and blast tuyere, as may be caused by thermally induced distortions for example, will not disrupt the properly orientation between the blast tuyere and the injection nozzle.

The supporting mechanism of the present invention also includes a device for urging the injection nozzle and blast tuyere toward the interior of the furnace. In accordance with the present invention at least some of the tubular tuyere stock defining members positioned upstream of the injection nozzle are flexibly interconnected in such a manner that compensation for thermal expansion and contraction will result even though the lower or nozzle portion of the tuyere stock is constrained to remain in substantially the same position at all times.

The above described supporting mechanism of the present invention permits the injection nozzle portion of the tuyere stock to be rigidly connected to the blast tuyere, for example by means of a detactable threaded connection, thereby precipitating a further improvement over the prior art and an additionally novel feature of the invention.

Thus, to summarize, the present invention provides a novel tuyere stock for shaft furnaces which includes a plurality of serially coupled tubular members lined with refractory material, at least one of said members being coupled to an adjacent tubular member by means of a universal coupling and flexible hermetic coupling means. The universal coupling between the tuyere stock tubular member is designed so as to absorb at least part of any relative displacements between said members. The tuyere stock of the present invention is further characterized by an injection nozzle which is rigidly connected to a blast tuyere situated in the wall of the furnace. The invention contemplates the provision of guide means for keeping the injection nozzle and blast tuyere in a preselected position with respect to the furnace wall and clamp means for urging the injection nozzle and thus also the blast tuyere against the wall of the furnace.

In accordance with a preferred embodiment of the invention, the tuyere stock comprises three tubular sections. The connections between said sections are provided by coupling means which includes a bellows and an articulated mechanical connection; the mechanical connection comprising a connecting ring, a first set of arms extending from one of the tubular sections to a pivotal connection to the connecting ring and a second set of arms extending from another adjacent tubular section and being pivotably connected to the connecting ring whereby two diametrically opposite arms are provided with slots in which bolts of the connecting ring can slide in the longitudinal direction.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
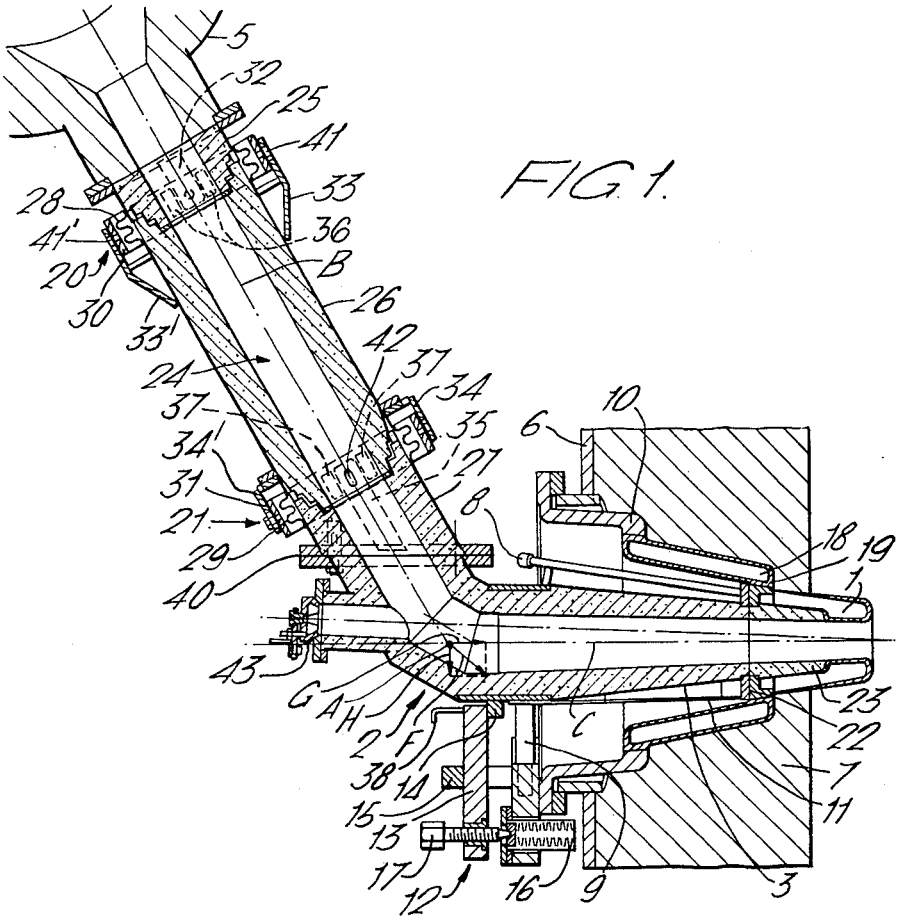
FIG. 1 is a cross-sectional, side elevation view of a preferred embodiment of a tuyere stock in accordance with the present invention.

The apparatus for delivering preheated air to a shaft furnace in accordance with the present invention comprises a tuyere stock which delivers air to a blast tuyere 1 from a supply; the supply being indicated in FIG. 1 by bustle pipe 5. The tuyere stock comprises an elbow section, indicated generally at 2, an injection nozzle downstream of the elbow section and a straight section, indicated generally at 24, which couples bustle pipe 5 to the elbow section. The straight section 24 of the tuyere stock is comprised of three cylindrical members 25, 26 and 27 interconnected by compensating coupling means indicated generally at 20 and 21. The elbow section 2 of the stock is connected, by means of a flange connection 40, to the lower tubular section 27 of the straight or linear portion of the stock. Flange connection 40 is preferably oriented horizontally in the interest of permitting elbow section 2 to be disconnected from the remainder of the stock and removed thereby facilitating servicing of nozzle 3 and blast tuyere 1. The elbow section 2 of the tuyere stock is provided with an inspection port 43 through which the "blowing-in" process in the furnace can be observed.

In the disclosed embodiment the tuyere stock injection nozzle 3 is integral with elbow section 2; the previously employed flange connection between these two portions of the stock being eliminated and the weight of the entire tuyere stock assembly thus being reduced. It is to be noted that the use in the prior art of a separate elbow section and injection nozzle was based upon the economic consideration that, upon damage to the injection nozzle, the nozzle could be replaced and the elbow section reused. In accordance with the present invention, since the possibility of damage to the tuyere stock injection nozzle 3 is virtually eliminated, the savings incident to an integral elbow section and nozzle are permitted.

The tubular sections 25, 26 and 27, the elbow section 2 and injection nozzle 3 which form the tuyere stock are all comprised of welded steel plates. Also, all of the enumerated components of the tuyere stock are lined internally with a refractory material 23.

The blast tuyere 1 will typically be comprised of copper and, in accordance with the preferred embodiment of the invention, will be rigidly connected to injection nozzle 3. Although the blast tuyere is water cooled, since this component is subjected to the high internal temperatures of the blast furnace, it will in time require replacement. Replacement of the blast tuyere 1 is facilitated in accordance with the present invention by employing a detactable flange and screw connection 22 to rigidly join the blast tuyere 1 to injection nozzle 3.

The fixed or rigid connection between the injection nozzle 3 and the blast tuyere 1 eliminates the ball-and-socket type spherical joint which has previously been customarily employed between these two components and thus provides a continuous connecting conduit for the hot air supplied to the furnace from pipe 5. The present invention also permits the internal lining of refractory brick 23 to be extended at least partly along the interior surface of blast tuyere 1. The blast tuyere 1 is, as noted and in accordance with previous practice, of hollow construction and is provided with cooling water supplied via conduits 8. Also, a blast tuyere cooler 18 is provided in the lining brickwork 7 of the wall 6 of the furnace; the conical inner surface 19 of the blast tuyere 1 being pressed into contact with the cooling jacket 18.

In the operation of the furnace, the preheated air delivered via the tuyere stock is preferably always blown into the furnace in the same direction; this direction typically being horizontally. Since the blast tuyere 1 is rigidly connected to the tuyere stock injection nozzle 3, nozzle 3 must be provided with means which keeps it in the same angular position with respect to the wall 6 of the blast furnace at all times. The maintenance of the constant angular position of the injection nozzle 3 and blast tuyere 1 with respect to the furnace wall is also required in the interest of insuring that the lining 7 on the internal wall of the furnace is not damaged by angular movements of the blast tuyere 1; i.e., the blast tuyere 1 must occupy a fixed position in the furnace wall lining 7 for proper operation.

Figure 2:
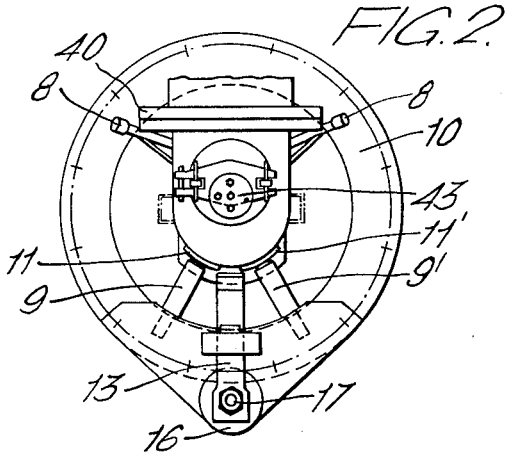
FIG. 2 is a front view of the lower portion of the tuyere stock of FIG. 1 as viewed from the exterior of the furnace.

As may best be seen from a joint consideration of FIGS. 1 and 2, in the interest of enabling the injection nozzle 3 and the blast tuyere 1 to be held in a preselected and preferably horizontal position, a pair of vertically extending guide bolts 9 and 9′ provided at the underside of the nozzle. Guide bolts 9 and 9′ are supported by and extend from a frame 10 which is attached, in any suitable manner, to the wall 6 of the furnace. The guide bolts 9 and 9′ respectively contact a pair of longitudinally extending channel-like members 11, 11′ provided on the bottom of injection nozzle 3. Members 11 and 11′, which define a pair of angularly displaced sliding surfaces, are comprised of steel plates welded, by means of struts where necessary, to the sheet metal outer wall of the injection nozzle. The two sliding surfaces 11 and 11′, as may be seen from FIG. 1, are oriented parallelly to the longitudinal axis of injection nozzle 3 and extend forwardly to a flange portion of the connecting means 22 at the tip of the injection nozzle. The heads of guide bolts 9 and 9′ are typically rounded as shown but may be fitted with bearings. The heads of guide bolts 9 and 9′ contact the respective sliding surfaces 11 and 11′, there being a transverse relationship between the bolts and surfaces at the point of contact, and prevent the injection nozzle 3 from being displaced in the downward direction. As may best be seen from FIG. 2, in order to prevent lateral displacement of the injection nozzle, the guide bolts and cooperating sliding surfaces on the injection nozzle are displaced at an angle from a vertical plane through the injection nozzle flow axis.

The above described arrangement for supporting injection nozzle 3 permits horizontal movements thereof with the members 11 and 11′ sliding on the heads of guide bolts 9 and 9′. Such sliding movement would not have been possible in the prior art due to the presence of the connecting flange previously required between the elbow section 2 of the tuyere stock and the injection nozzle 3. Any necessary compensation for horizontal movements of injection nozzle 3 will be provided, as in the prior art, by the coupling between the elements which comprise the longitudinal portion 24 of the tuyere stock. Similarly, since the supporting means for injection nozzle 3 prevents either downward or lateral movement thereof, any expansion or contraction which would tend to cause vertically downward or lateral movement will be transmitted to and taken up by the compensating couplings 20 and 21 of the longitudinal portion of the tuyere stock.

As will be described below, during operation injection nozzle 3 is always urged in the direction of the wall of the furnace by forces induced in the tuyere stock. However, in order to insure that a predetermined minimum contact pressure will always be present, the supporting means for injection nozzle 3 further comprises a locating device indicated generally at 12. The locating device 12 includes a pin or lever member 13 which contacts and, in the manner to be described below, presses against a stop 14 provided on the bottom side of the injection nozzle 3. The lever 13 is positioned behind a holding device 15 attached to the frame 10 and the requisite contact pressure applied to the stop 14 is generated by a spring 16; spring 16 pressing against the lower end of lever 13 via the intermediary of a set screw 17. The pressure applied to stop 14 by lever 13 can, of course, be varied by adjustment of set screw 17. The spring 16 is positioned within a housing affixed to the furnace wall 6 via the frame 10. The removal of lever 13 from its mounting is facilitated by the provision of an angle piece 38 welded to the upper end of lever 13.

To briefly summarize the preceding description of the preferred embodiment of the invention, the guiding and contact pressure applying means cause the integral elbow section 2, injection nozzle 3 and blast tuyere 1 to retain the same position with relation to the blast furnace wall at all times. This position will typically be as near to the horizontal as possible. The means for supporting the injection nozzle insures that the nozzle and the blast tuyere 1 affixed thereto can not tilt out of their central position in the aperture in the wall of the furnace.

In order to absorb or compensate for the dimensional deviations always discovered to be present during installation, and also to compensate for thermal expansions occurring during operation, the tuyere stock of the present invention is preferably provided with compensators 20 and 21 as noted above. Compensators 20 and 21 are of the universal joint type described in previously referenced U.S. Pat. No. 3,662,696 and copending application Ser. No. 228,417, now U.S. Pat. No. 3,766,868. Each of the compensators 20 and 21 includes a bellows, respectively indicated at 28 and 29, supported externally thereof by means of respective Cardan rings 30 and 31. The Cardan rings 30 and 31 are connected to the corresponding straight tubular sections of the stock via hinged arms 32, 32′ (not shown); 33, 33′; 34, 34′; and 35, 35′ (not shown) respectively. The connection between each hinged arm and its associated Cardan ring is provided by means of a bolt. For constructional and thermal reasons the angular movements of the universal compensating joints have to be kept within certain limits; this being achieved by means of stops 36 and 37. Further, in accordance with the present invention the ball pivot connection between the injection nozzle and the blast tuyere has been eliminated and the lower portion of the tuyere stock is always held in the same position. Accordingly, any relative movements between the upper and lower portions of the tuyere stock must be intercepted in the joints 20 and 21. These requirements necessitate a modification to the universal joint compensators 20 and 21 of the present invention when compared to the compensators of the referenced patent and application. In accordance with this modification oppositely disposed hinged arms 33, 33′ and 35, 35′ (not shown) of respective compensators 20 and 21 are provided with respective slots 41, 41′ and 42, 42′ (not shown). The slots permit the hinged arms to undergo a degree of longitudinal displacement with relation to the Cardan rings. Some of the relative movements between the individual parts of the tuyere stock; for example caused by thermally induced expansion in either the stock, the bustle pipe or the wall of the furnace; are thus absorbed by the relative displacement possible between the arms of the universal joints and the cardan rings. The remainder of the relative movements which must be taken into account are taken up by the universal joint compensators as disclosed in referenced U.S. Pat. No. 3,662,696 and copending application, Ser. No. 228,417, now U.S. Pat. No. 3,766,868.

The aforementioned slots provided in two diametrically opposite hinged arms of the universal joint compensators can be offset by 90° from one compensator to the next, without any appreciable change in operation, or the slots can be situated in the same plane. The remaining hinged arms of the compensators 20, 21 are connected by pivot bolts to the respective Cardan rings in the usual manner; i.e., as discussed in the referenced patent and application; and are not provided with slots at the connection points. Thus, if the arms 33 and 33' of universal joint compensator 20 are provided with slots, arms 32 and 32' (not shown) will not have slots. Restated, all four hinged arms of each of the universal joint compensators 20 and 21 will not be provided with the expansion permitting slots in the interest of insuring stability. On the other hand, it may be possible, according to the particular structural loading and expansions experienced, for only two diametrically opposed arms of only one of the universal joint connections to be provided with the slotted coupling.

In FIG. 1 the forces which are generated at the intersection point A of the longitudinal axes B and C of the tuyere stock are shown diagramatically. The force F, occurring at point A as a result of thermal expansion and hot air impingement, will be divided into a horizontally operative component G and a vertical component H as a result of the holding support of elbow section 2 by bolts 9 and 9'. The horizontal component of force G presses the injection nozzle 3 and thus the blast tuyere 1 against the conical sealing surface 19 of the blast tuyere cooler 18 thus exerting an effective sealing action with relation to the interior of the furnace and insuring the establishment of a heat transfer relationship between cooler 18 and tuyere 1. The vertical force component H causes the injection nozzle 3 to be pressed downwardly against the fixed position guide bolts 9 and 9' and thus prevents elbow section 2 from undergoing any upward movement. Any thermal expansion will be primarily taken up in the slots of the hinged arms of universal joints 20 and 21. If the expansion or absorption capacity of the slotted compensator arms is exceeded, the excess expansion is converted into angular displacement of the central section 26 of the stock; such angular displacement being permitted by the use of the two universal joint compensators 20 and 21. Regardless of the amount of expansion and thus of the angular relationship between the three tubular members which comprise the longitudinal section 24 of the tuyere stock, the universal compensating joints 20 and 21 remain hermetically sealed by the respective compressible bellows 28 and 29.

As will now be obvious to those skilled in the art, the rigid mechanical connection between the blast tuyere and the tuyere stock injection nozzle eliminates a potential leakage point; i.e., the spherical sealing surface between the tuyere stock and the blast tuyere; which has characterized the prior art. Elimination of this spherical sealing surface, in turn, virtually eliminates the need for periodic injection nozzle replacement, enhances the average usable life expectancy of the blast tuyere and generally provides for more efficient furnace operation since down-time is reduced.

The achievement of the above advantages and improvements over the prior art is in part attributable to the fact that the blast tuyere may be at least partly lined with a refractory material in accordance with the present inventin whereby the direct supply of heat to the blast tuyere from the heated air being injected to the furnace is reduced. This reduction in heat transfer, accordingly, renders the blast tuyere less subject to damage from overheting. Also, as previously noted, since the possibility of damage to the tip of the injection nozzle has been overcome by the present invention, the previously employed flange connecting the elbow section of the tuyere stock to the injection nozzle may be eliminated. The elimination of this connecting flange, in turn, simplifies the overall construction and reduces the weight of the entire tuyere stock. The required sealing of the surface between the blast tuyere and the tuyere cooler is, in the disclosed embodiment of the invention, insured by the prestressing of the guiding device via lever 13 and by the horizontal force component of the expansion forces occurring in the tuyere stock.

The advantages of the tuyere stock construction of the present invention, when compared to the prior art, become particularly evident when the damaged blast tuyere has to be removed and replaced. It was previously necessary to first dismantle the elbow section and the injection nozzle of the tuyere stock in order to obtain access to the damaged blast tuyere. Thereafter, specially designed extraction tools were employed to withdraw the damaged blast tuyere from the furnace wall and a new blast tuyere was inserted in the same manner. Thereafter, the lower portions of the tuyere stock were reinserted, the entire stock reassembled and the necessary adjustments attempted. In accordance with the present invention, the lower part of the tuyere stock is disconnected from the remaining portions of the stock at flange 40 and the elbow portion of the stock, the injection nozzle and the blast tuyere are removed and reinserted in a single operation and without the need for any special tools.

Although a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a tuyere stock for use in the delivery of a heated gas from a source to a nozzle, said tuyere stock including a plurality of serially connected tubular members, the improvement comprising:

means rigidly connecting said nozzle to a first end of said tuyere stock; and guide means for supporting said first end of said tuyere stock whereby said nozzle will be maintained in a preselected position, said guide means permitting movement of said stock axially of the desired orientation of the nozzle axis.

2. The apparatus of claim 1 further comprising:

clamp means for urging said stock in the axially forward direction.

3. The apparatus of claim 2 wherein said nozzle is a blast tuyere of a furnace and wherein said tubular members comprising the tuyere stock are connected together by universal joints including flexible hermetic coupling means.

4. The apparatus of claim 3 wherein said guide means comprises:

a plurality of spacially displaced guide surface defining members affixed to the tuyere stock; and support means mounted from the furnace wall and including a plurality of support members which respectively engage said surface defining members.

5. The apparatus of claim 4 wherein said tuyere stock includes an injection nozzle portion to which the blast tuyere is rigidly connected and wherein said guide surface defining members are affixed to the exterior of said injection nozzle portion and define sliding surfaces parallel to the axis of the injection nozzle.

6. The apparatus of claim 5 wherein said support members are oriented radially with respect to the axis of said tuyere stock injection nozzle portion and at least two support members are positioned in a plane transverse to the injection nozzle axis whereby angular movements of said blast tuyere are impeded.

7. The apparatus of claim 3 further comprising:

a lining of refractory material at least partly defining the inner diameter of the blast tuyere.

8. The apparatus of claim 5 further comprising:

a lining of refractory material at least partly defining the inner diameter of the blast tuyere, said blast tuyere refractory material lining forming an extension of a refractory material lining on the interior of the tuyere stock injection nozzle portion.

9. The apparatus of claim 6 further comprising:

a lining of refractory material at least partly defining the inner diameter of the blast tuyere, said blast tuyere refractory material lining forming an extension of a refractory material lining on the interior of the tuyere stock injection nozzle portion.

10. The apparatus of claim 3 wherein said universal joints include an articulated mechanical connection defined by a connecting ring, two sets of arms having individual arms thereof offset by 90° and pivotably connected to said connecting ring, said apparatus further comprising:

means for absorbing at least part of any relative displacements between said stock defining tubular members, said displacement absorbing means including slotted connections between at least one of said sets of arms of at least one of said universal joints and the associated connecting ring.

11. The apparatus of claim 10 wherein said tuyere stock includes at least three straight sections coupled by two of said universal joints and wherein slotted connections are provided in two successive joints, said slotted connections being diametrically offset from a first to a second joint.

12. The apparatus of claim 6 wherein said universal joints include an articulated mechanical connection defined by a connecting ring, two sets of arms having individual arms thereof offset by 90° and pivotably connected to said connecting ring, said apparatus further comprising:

means for absorbing at least part of any relative displacements between said stock defining tubular members, said displacement absorbing means including slotted connections between at least one of said sets of arms of at least one of said universal joints and the associated connecting ring.

13. The apparatus of claim 12 wherein said tuyere stock includes at least three straight sections coupled by two of said universal joints and wherein slotted connections are provided in two successive joints, said slotted connections being diametrically offset from a first to a second joint.

14. The apparatus of claim 11 further comprising:

a lining of refractory material at least partly defining the inner diameter of the blast tuyere.

15. The apparatus of claim 13 further comprising:

a lining of refractory material at least partly defining the inner diameter of the blast tuyere, said blast tuyere refractory material lining forming an extension of a refractory material lining on the interior of the tuyere stock injection nozzle portion.

* * * * *